United States Patent [19]

Bratland et al.

[11] Patent Number: 4,826,183

[45] Date of Patent: May 2, 1989

[54] SKATE

[76] Inventors: Jan Bratland, Krokliveien 19B, o584 Oslo 5; Finn Halvorsen, Bekkeberget, 2022 Gjerdrum, both of Norway

[21] Appl. No.: 127,300

[22] PCT Filed: Mar. 11, 1987

[86] PCT No.: PCT/NO87/00019

§ 371 Date: Nov. 30, 1987

§ 102(e) Date: Nov. 30, 1987

[87] PCT Pub. No.: WO87/05818

PCT Pub. Date: Oct. 8, 1987

[30] Foreign Application Priority Data

Mar. 26, 1986 [NO] Norway ..... 861225

[51] Int. Cl.[4] ..... A63C 17/18

[52] U.S. Cl. ..... 280/7.13; 280/11.12; 280/11.18; 280/11.22; 280/11.3; 36/87; 36/115

[58] Field of Search ..... 280/11.1 R, 11.12, 11.13, 280/11.17, 11.18, 11.19, 11.14, 600, 11.22, 11.3, 7.13; 36/87, 115, 117

[56] References Cited

U.S. PATENT DOCUMENTS 3,512,195 5/1970 Porsche ..... 280/18
3,934,892 1/1976 Baikie ..... 280/11.12
4,114,295 9/1978 Schaefer ..... 280/11.19
4,336,948 6/1982 Couture ..... 280/11.12
4,351,537 9/1982 Bratland et al. ..... 280/11.12

FOREIGN PATENT DOCUMENTS 328347 10/1976 Austria .
136281 12/1971 Norway .

*Primary Examiner*—David M. Mitchell
*Assistant Examiner*—Brian S. Johnson
*Attorney, Agent, or Firm*—Holman & Stern

[57] ABSTRACT

Skate comprises a shoe portion (1) a ground touching device (11) and a transition portion (3) which connects the ground touching device (11) to the shoe portion (1). The shoe portion (1) and the transition portion (3) are made in one piece and form a shell of a sandwich construction with a core (5) made of foam plastic and outer layers (6,7) made of plastic reinforced with glass or carbon fibers. The ground touching device (11) may be a metal section fastened by glue in a downwards opening groove (1) formed in the transition portion (3) and adapted to glide on ice or rollers arranged in the groove and adapted to rotate about respective shafts fastened to the transition portion. There is thus provided a very light skate which renders good support to the foot and has little air resistance.

17 Claims, 2 Drawing Sheets

SKATE

CROSS REFERENCE TO RELATED APPLICATION(S)

This United States application stems from PCT International Application No. PCT/NO87/00019 filed Mar. 11, 1987.

BACKGROUND OF THE INVENTION

1. Field of the Invention

The invention relates to a skate comprising a shoe portion, a ground touching device and a transition portion which connects the shoe portion to the ground touching device, the shoe portion and the transition portion being formed in one piece.

2. Description of the Prior Art

Within many field of atlethics and sports the advantages of new materials, such as different types of foam plastic with different properties, glass or carbon fiber reinforced plastic, etc., have been realized in the production of athletic and sports equipment. In addition to providing lighter and stronger equipment, such materials have made possible equipment having designs and qualities which were earlier unattainable.

However, as to skates, newer materials have been adopted only to a small extent despite the fact that there could be reason to assume that low equipment weight for example could contribute to improved records in speed-skating and permit faster movements during ice-hockey and bandy playing and figure skating.

It is known that skates for figure skating, bandy, ice-hockey and speed skating as well as roller skates for use by skaters during training may have a leather shoe connected to a metal base part. This base part may comprise one or more metal plates contacting the sole of the shoe and riveted thereto. To the metal plates there may be fastened by brazing, spot welding or the like, metal sections extending downwards, and the lower end portion thereof may in a a similar way be connected to a metal section extending generally parallel to the sole, to which section is fastened a further metal section or runner adapted to glide on ice, or a number of wheel axles with wheels.

This design has existed unchanged for a very long time in spite of changes proposed for example known skates for speed skating seem to be too heavy, render little support to the foot and offer large air resistance.

Further, there exist ice-hockey skates where the shoe portion is made of solid, cast plastic and where a conventional metal base part is cast into the sole portion. Skates of this type are not lighter than previously known skates, but they probably offer better protection of the feet of the players against blows and kicks to the feet during games.

BRIEF SUMMARY OF THE INVENTION

The purpose of the invention is to provide a skate which is not burdened with the above-mentioned disadvantages.

This is accomplished by the skate according to the invention having a shoe portion, a ground touching device and a transition portion which connects the ground touching device to the shoe portion. The shoe portion and the transition portion are made in one piece and form a shell of a sandwich construction with a core made of foam plastic and outer layers made of plastic reinforced with glass or carbon fibers. The ground touching device may be a metal section fastened by glue in a downwards opening groove formed in the transition portion and adapted to glide on ice, or rollers arranged in the groove and adapted to rotate about respective shafts fastened to the transition portion. There is thus provided a very light skate which renders good support to the foot and has little resistance.

The invention will now be explained in detail in the following description with reference to the accompanying drawings, which show embodiments of a skate according to the invention, and wherein.

DETAILED DESCRIPTION

In the description it will be assumed that the position of the skate corresponds to its position when it is carried on the foot of a standing person, and indicated relative positions and directions shall be understood as being referred to this skate position.

Figure 1:
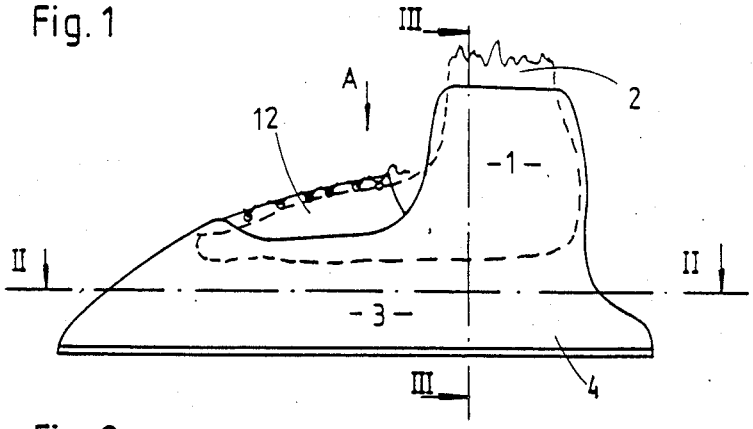
FIG. 1 is a side elevational view of a skate for speed skating according to the invention.
Figure 2:
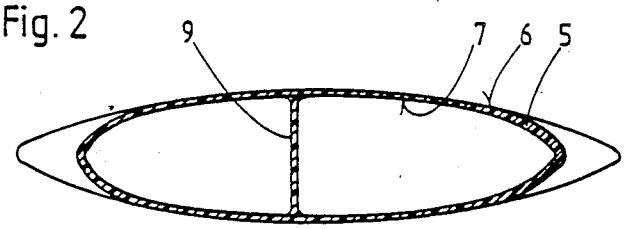
FIG. 2 is a cross sectional view taken along the line II—II in FIG. 1.
Figure 3:
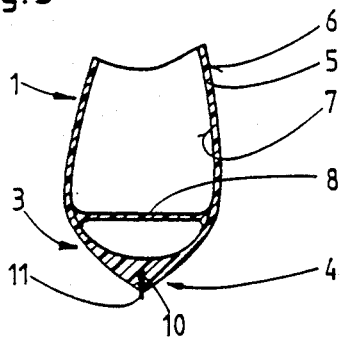
FIG. 3 is a cross sectional view taken along the line III—III in FIG. 1.

As can be seen in FIG. 1–3 a skate for speed skating according to the invention comprises a shoe portion 1 adapted to contain a foot indicated with dotted lines, and a transition portion 3, the right and left sides of which extend downward by forming a V-shaped by the right and left sides of the shoe portion 1, while its forward and rear portions extend downwardly and forwardly and rearwardly respectively from the shoe portion, the transition portion 3 and the shoe portion 1 thus forming a generally upwardly facing open or concave shell. In order to obtain great strength and small weight this shell is made as a sandwich comprising a core 5 made of plate shaped, stiff plastic foam and two layers of plastic material 6, 7 reinforced by glass fibers or carbon fibers, for example and glued to opposite sides of the core 5.

Between the upright sides of the shell there may be glued a plate or sole 8 adapted to the foot and serving as a support for the foot, and for support and stiffening of the sole and the shell portions there may be glued therebetween one or several ribs 9. As a support for the foot and for stiffening of the shell portions there may alternatively therebetween be glued a piece (not shown) made of rigid foam plastic for example adapted to the intermediate space between the shell portions, the upper surface being adapted to the the shape of the sole of the foot, or the intermediate space between the shell portions may be filled with a liquid plastic, which in hardened condition forms a rigid foam adhering to the shell side surfaces, and the upper surface of which before finished hardening is formed as a sole surface adapted to the sole of the foot.

In the lower part of the transition portion 3 there is formed a connection portion 4 with a groove 10 opening downwardly and extending the entire length of the skate, in which groove there is fastened a metal section 11 adapted to the groove 10, the length of the metal section 11 corresponding to the length of the groove and the metal section being adapted for contact with and gliding on the ground i.e. the ice. The cross section of the metal section may be rectangular, T-shaped or formed otherwise. In order to obtain a hard gliding surface the section 11 may be coated with a ceramic material. Further it may be fastened to the connection portion 4 by means of glue, screws or the like, or be clamped between the side portions of the groove by means of suitable clamping devices or the like.

Figure 4:
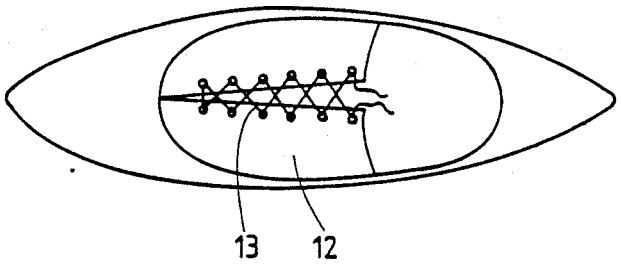
FIG. 4 is a top plane view in the direction of the arrow A in FIG. 1.

In a known manner the side of the sole facing the foot and the shoe portion 1 may be lined with a soft material, for example hardenable foam plastic injected between the foot and the skate for achieving the best possible adaption to the foot of a particular person, and an instep piece 12 made of leather or cloth adapted to be tightened by means of shoe laces, hook and pile fasteners, or the like, may be fastened to the edges of the shoe portion 1 adjacent to the forward part of the foot, as shown in FIGS. 1 and 4.

Figure 5:
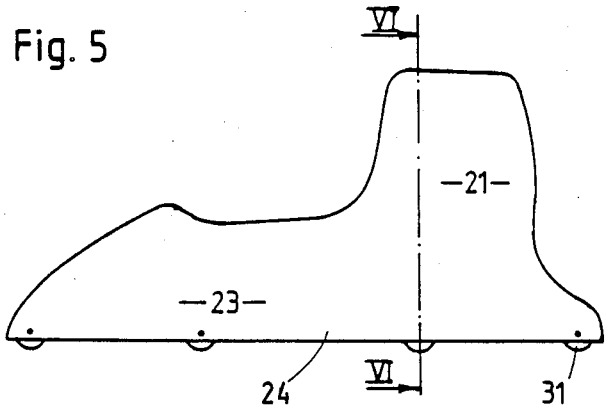
FIG. 5 is a side elevational view of a roller skate in accordance with the invention.
Figure 6:
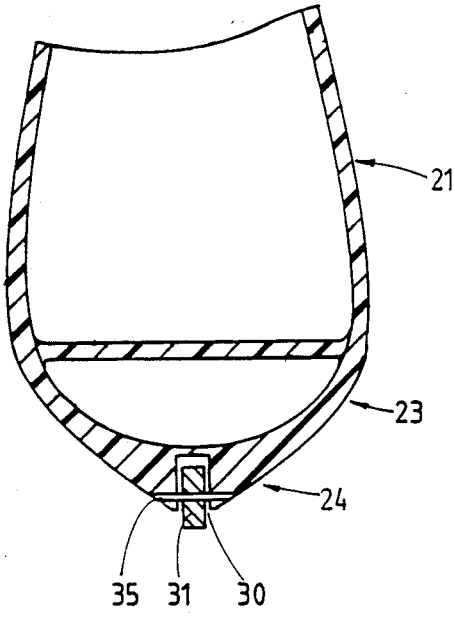
FIG. 6 is an enlarged cross sectional view taken along the line VI—VI in FIG. 5.

In FIG. 5 and 6 there is shown a roller skate for use for skaters during training, for instance in the summer.

The shoe portion 21, the transition portion 23 and the connection portion 24 are principally produced as corresponding portions of the above-mentioned skate for speed skating. The difference is mainly that two or more wheels 31 are arranged in a row and spaced in a groove 30 extending in the longitudinal direction of the connection portion 24 in such a way that they extend a small distance below the lower edge of the connection portion 24. Wheel mounting shafts 35 extend through pairs of transverse, coaxial holes formed in the side walls of the groove 30 and a central hole formed in each wheel 31. In a known manner each shaft may be fastened to the connection portion 24 and adapted to prevent axial movement of the corresponding wheel while rotation thereof on the shaft is permitted. The wheels 31 may be provided with ball bearings which in a known manner are connected to the respective shafts and wheels in such a way that the wheels 31 can turn freely on their shafts without touching the side walls 30 of the groove.

For support and relief of the ankle joint the rear right and left area of the shoe portion may in a known manner be extended upwards past the ankle. The ankle musculature can thereby be relaxed correspondingly and energy be saved during speed skating competitions.

There has been described above a skate for speed skating and a roller skate according to the invention. However, it is of course possible to produce skates for bandy, figure skating or ice-hockey in a similar way.

However, as to ice hockey skates, the shoe portion should give protection for the foot and the ankle against the blows occurring during matches. The above mentioned instep piece may therefore comprise a plate made of laminated or solid plastic adapted to the foot and the skate.

We claim:

1. In a skate having a shoe portion, a ground touching portion and a transition portion connecting the shoe portion to the ground touching portion, the shoe and transition portion being of one piece construction, the improvement comprising:

walls having inner and outer sides in the shoe portion adapted to enclose a wearers' foot;

walls having inner and outer sides forming the transition portion;

said walls being integrated as a unitary shell having a sandwich construction comprising a core of foam plastic, outer layers of plastic material attached to the inner and outer sides of said walls, and fiber reinforcing in said outer layers;

said transition portion having a substantially V-shaped cross-sectional configuration having an upper part joining said shoe portion and a lower part;

a sole means within said shell between and connected to said walls thereof;

said outer layer on the outer sides of said wall extending continuously from the upper part of said shoe portion to the lower part of said transition portion and said outer layer on the inner sides of said walls extending continuously from the upper part of said shoe portion to a level below said sole means;

a groove in the outer surface of said lower part of said transition portion extending in the longitudinal direction of the skate; and a ground engaging means mounted in said groove.

2. A skate as claimed in claim 1 wherein:

said sole means comprises a planar member extending in the longitudinal direction of the skate and attached to said inner sides of said walls of said shell; and at least one planar rib extending transversely to the longitudinal direction of the skate between and attached to said inner sides of said walls of said shell, said planar sole member and said lower part of said transition portion.

3. A skate as claimed in claim 1 wherein:

said sole means comprises a sole piece of rigid foam plastic filling said transition portion and attached to said inner sides thereof for stiffening said shell.

4. A skate as claimed in claim 1 wherein:

said ground engaging means comprises an ice skate runner.

5. A skate as claimed in claim 1 wherein:

said ground engaging means comprises a plurality of rotatable wheel means mounted in relative spaced relationship in said groove in the longitudinal direction of the skate.

6. A skate as claimed in claim 2 wherein:

said ground engaging means comprises an ice skate runner.

7. A skate as claimed in claim 3 wherein:

said ground engaging means comprises a plurality of rotatable wheel means mounted in relative spaced relationship in said groove in the longitudinal direction of the skate.

8. A skate as claimed in claim 1 wherein:

said fiber reinforcing comprises glass fibers.

9. A skate as claimed in claim 2 wherein:

said fiber reinforcing comprises glass fibers.

10. A skate as claimed in claim 2 wherein:

said fiber reinforcing comprises carbon fibers.

11. A skate as claimed in claim 9 wherein:

said ground engaging means comprises an ice skate runner.

12. A skate as claimed in claim 10 wherein:

said ground engaging means comprises an ice skate runner.

13. A skate as claimed in claim 9 wherein:

said ground engaging means comprises a plurality of rotatable wheel means mounted in relative spaced relationship in said groove in the longitudinal direction of the skate.

14. A skate as claimed in claim 10 wherein:

said ground engaging means comprises a plurality of rotatable wheel means mounted in relative spaced relationship in said groove in the longitudinal direction of the skate.

15. A skate as claimed in claim 5 wherein each wheel means comprises:

a shaft extending transversely through said groove at right angles to said longitudinal direction of the skate;

opposite ends on said shaft mounted in said lower part of said transition portion; and a wheel rotatably mounted on said shaft and disposed in said groove for rotation therein on said shaft.

16. A skate as claimed in claim 15 wherein:

said fiber reinforcing comprises glass fibers.

17. A skate as claimed in claim 15 wherein:

said fiber reinforcing comprises carbon fibers.

* * * * *